US005353658A

United States Patent [19]

Nagashima et al.

[11] Patent Number: 5,353,658

[45] Date of Patent: Oct. 11, 1994

[54] STARTER

[75] Inventors: Shinichi Nagashima; Hitoshi Ono, both of Gumma, Japan

[73] Assignee: Mitsuba Electric Mfg. Co., Ltd., Gumma, Japan

[21] Appl. No.: 75,078

[22] Filed: Jun. 10, 1993

[30] Foreign Application Priority Data

Jun. 12, 1992 [JP] Japan ..... 4-946851[U]

[51] Int. Cl.[5] ..... F02N 15/06

[52] U.S. Cl. ..... 74/7 A; 74/7 C; 74/7 E

[58] Field of Search ..... 74/7 A, 7 C, 7 E

[56] References Cited

U.S. PATENT DOCUMENTS 4,440,033 4/1984 Kurihara et al. ..... 74/7 A 4,779,470 10/1988 Horita et al. ..... 74/7 A X

FOREIGN PATENT DOCUMENTS 3-41169 4/1991 Japan .

*Primary Examiner*—Allan D. Herrmann

*Attorney, Agent, or Firm*—Skjerven, Morrill, MacPherson, Franklin, & Friel

[57] ABSTRACT

In a starter for internal combustion engines, a tubular pinion gear support shaft 8 is rotatably supported by a casing, and coupled to a drive shaft of a motor so as to be rotatively driven by the motor, and an annular pinion gear 3 is fitted on the pinion gear support shaft in axially slidable but rotatively drivable relationship. A push rod 9 is axially slidably received in the tubular pinion gear support shaft and provided with a free end engaged with a free end of the pinion gear for transmitting a shifting force for driving the pinion gear into meshing with a ring gear of an engine from a shift lever to the push rod. A shift spring 15 consisting of a compression coil spring is coaxially received in the pinion gear support shaft and interposed between an associated end of the shift lever and a base end of the push rod. Thus, the assembling of the starter is simplified while the action of the shift spring is stabilized, and the design of the starter is made compact.

5 Claims, 1 Drawing Sheet

STARTER

TECHNICAL FIELD

The present invention relates to a starter for internal combustion engines, and in particular to such a starter in which a pinion gear is selectively meshed with the ring gear of an engine by displacing a pinion shaft for transmitting torque from the motor by using a shift lever which rotates in response to the displacement of an armature of a magnetic switch.

BACKGROUND OF THE INVENTION

In a conventional starter motor for automobiles, for instance the one disclosed in Japanese utility model application laid-open publication (kokai) No. 3-41169, a pinion gear is selectively meshed with the ring gear of an engine, and is rotatively driven by a motor by using a shift lever which rotates according to the displacement of an armature of a magnetic switch.

In a starter of such a structure, the pinion gear is axially slidably fitted on a rotatably supported pinion shaft, and is adapted to move axially in either direction integrally with the push rod which is passed through the pinion gear support shaft.

It sometimes happens that the pinion gear is not able to readily mesh with the ring gear, and buffering means is therefore needed between the armature of the magnetic switch and the push rod. As such buffering means, it has been proposed to use a shift spring consisting of a torsion coil spring which, coaxially mounted on a central pivot shaft for the shift lever, has its one end engaged with the armature and its other end engaged with the shift lever. Thus, when the magnetic switch is activated, but the pinion gear is unable to mesh with the ring gear, and the shift lever is therefore not yet fully rotated as it should, the displacement of the armature is accommodated by the twisting deformation of the shift spring.

However, the shape of the shift lever tends to be complicated because of the need to mount the torsion coil spring thereon, and the efforts required to mount the torsion coil spring may become substantial because of the large initial loading of the torsion coil spring which is required to ensure a sufficiently large force for pushing the push rod or the pinion gear, and also because of the complicated shape of the shift lever. Further, the action of the torsion coil spring tends to be unstable because it is mounted on the pivot shaft of the shift lever, and the loading of the torsion coil spring tends to cause a substantial frictional force acting between the pivot shaft and the torsion coil spring. This frictional force has a tendency to destablize the behavior of the associated contacts of the magnetic switch. To stabilize the action of the torsion coil spring, it is necessary to increase the mounting precision and to design a complicated shape of the shift lever, but it in turn increases the efforts required for assembling the associated parts.

BACKGROUND OF THE INVENTION

In view of such problems of the prior art, a primary object of the present invention is to provide a starter which is easy to assemble, and features a stable action of the shift spring.

A second object of the present invention is to provide a starter which is compact, and easy to assemble.

According to the present invention, such an object can be accomplished by providing a starter for an internal combustion engine, comprising: a casing; a motor attached to the casing; a tubular pinion gear support shaft rotatably supported by the casing, and coupled to a drive shaft of the motor so as to be rotatively driven by the motor; an annular pinion gear fitted on the pinion gear support shaft in axially slidable but rotatively drivable relationship, the pinion gear being slidable between a retracted position and a extended position adapted for engagement with a ring gear of the internal combustion engine; a return spring for urging the pinion gear toward the retracted position; a push rod axially slidably received in the tubular pinion gear support shaft and provided with a free end engaged with a free end of the pinion gear for transmitting a shifting force for driving the pinion gear from the retracted position to the extended position; a shift lever pivotally supported by the casing for transmitting the shifting force from a magnetic switch to the push rod; and a shift spring consisting of a compression coil spring coaxially received in the pinion gear support shaft and interposed between an associated end of the shift lever and a base end of the push rod.

Thus, by providing a shift spring consisting of a compression coil spring between the push rod and the shift lever in a coaxial relationship with respect to the push rod, the shift lever may be simplified in shape, and the assembling work is simplified because there is no need to mount a torsion coil spring in a pre-stressed condition on the shift lever. Further, the use of a compression coil spring as the shift spring allows a stable action of the shift spring, and a compact design of the starter.

According to a preferred embodiment of the present invention, the base end of the push rod is provided with an external radial flange, and the shift spring is coaxially received in a sleeve member having an internal radial flange engaged with the external radial flange of the push rod, the return spring consisting of a compression coil spring which is received coaxially between the push rod and the pinion gear support shaft, and is interposed between an external end surface of the internal radial flange and an opposing annular shoulder surface defined in the pinion gear support shaft. Further, a disk member serving as a spring retainer is received in the sleeve member and interposed between the associated end of the shift lever and a first end of the shift spring, the sleeve member being provided with means for retaining the shift spring inside the sleeve member against the biasing force of the shift spring, and a second end of the shift spring is engaged with the external radial flange.

In view of compact design, it is particularly preferable to provide the axial line of the pinion gear and the motor to be offset from each other, and make use of an annular input gear coaxially supported around the pinion gear support shaft with a one-way clutch interposed therebetween so that a drive gear mounted on the drive shaft of the motor may mesh with the input gear for transmitting the rotational force of the motor to the pinion support shaft.

For the convenience of assembling, the input gear may be freely rotatably supported on the pinion gear support shaft while the one-way clutch has an output end securely fitted on the pinion gear support shaft and an input end engaged with the input gear via coupling means which couples the input end and the input gear in axially slidable but rotatively drivable relationship.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
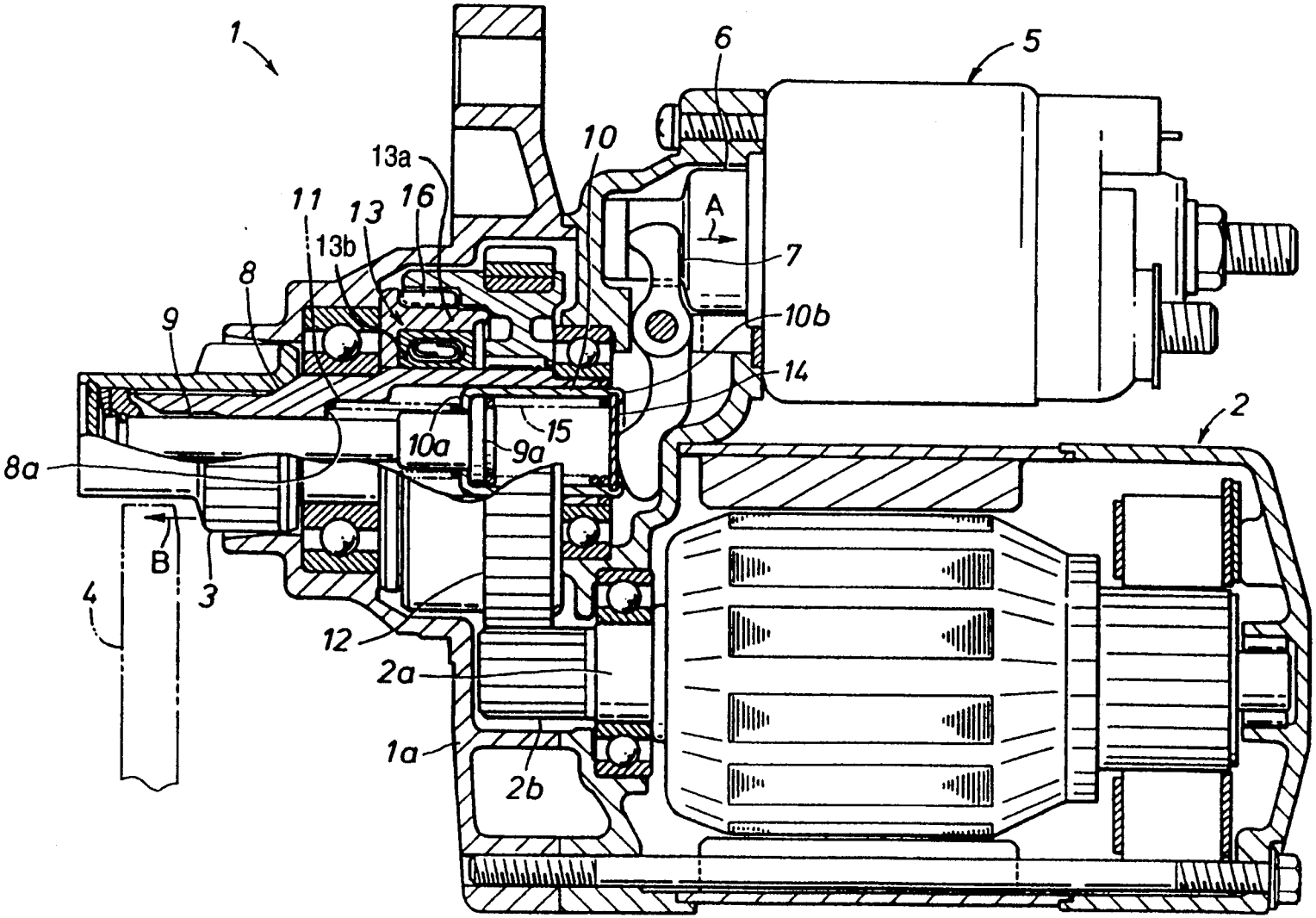
FIG. 1 is a sectional side view of an essential part of a starter for automobiles according to the present invention.

FIG. 1 is a sectional side view of an essential part of a starter 1 mounted on the engine of an automobile, taken along an axial line. This starter 1 is intended to drive an annular pinion gear 3 which is rotated by a motor 2 in such a manner that the pinion gear 3 may be selectively meshed with a ring gear 4 of the engine which is not shown in the drawings, and by turning on a magnetic switch 5 integrally provided in the starter 1 the shifting movement of the pinion gear 3 and the rotation of the motor 2 are both accomplished. As illustrated in the drawing, between an armature 6 of the magnetic switch 5 and the pinion gear 3 is provided a shift lever 7 consisting of a fork member which brings about an interaction between the armature 6 and the pinion gear 3 in such a manner that the pinion gear 3 undergoes a shifting movement in synchronism with the axial displacement of the armature 6.

The pinion gear 3 is coaxially fitted on a pinion gear support shaft 8 extending in parallel with the axial line of the motor 2 and rotatably supported by a casing la of the starter 1, and is coupled with the pinion gear support shaft 8 by splines so as to transmit torque in a circumferential direction and to be able to move freely in axial direction. This pinion gear support shaft 8 consists of a hollow shaft member, and coaxially accommodates therein a push rod 9. The rear end of the push rod 9 is provided with an external radial flange 9*a*, and is slidably and coaxially received in a sleeve member 10.

One axial end of the sleeve member 10 associated with the external radial flange 9*a* of the push rod 9 is provided with an internal radial flange 10*a* which can engage with a shoulder surface of the external radial flange 9*a* facing the pinion gear 3, and a return spring 11 consisting of a compression coil spring is interposed between an annular internal shoulder surface 8*a* of the pinion gear support shaft 8 and an outer end surface of the internal radial flange 10*a* for urging the push rod 9 in the direction to retract the pinion gear 3.

In the rear end of the sleeve member 10 facing the shift lever 7 is received a circular disk-shaped spring retainer 14 so as to close the opening defined by the rear end of the sleeve member 10, and is prevented from moving out of the sleeve member 10 by inwardly crimping the circular rear edge 10*b* of the sleeve member 10. A shift spring 15 consisting of a compression coil spring is coaxially received in the sleeve member 10, and is pre-compressed with a certain load between the external radial flange 9*a* and the spring retainer 14. Therefore, in the illustrated initial condition, the external radial flange 9*a* and the internal radial flange 10*a* are placed in a mutually abutting condition by being elastically interposed between the return spring 11 and the shift spring 15.

In the de-energized condition of the magnetic switch 5, the armature 6 projects out of the magnetic switch 5 by being biased by an internally provided return spring not shown in the drawing, and the shift lever 7 having one of its ends engaged by a slot provided on the projected end of the armature 6 is engaged with the outer surface of the spring retainer 14 at its other end. The outer circumferential surface of the pinion gear support shaft 8 supports an input gear 12 in a freely rotatable manner, and a drive shaft 2*a* of the motor 2 and the pinion gear support shaft 8 are mutually coupled by a drive gear 2*b* mounted on the drive shaft 2*a* and meshing with the input gear 12. A one-way clutch 13 is provided between the input gear 12 and the pinion gear support shaft 8 for transmitting the torque applied to the input gear 12 to the pinion gear support shaft 8.

The one-way clutch 13 has an output end 13*b* securely fitted on the pinion gear support shaft 8 and an input end 13*a* provided with an external gear while the input gear 12 is provided with an internal gear which meshes with the external gear of the input end of the one-way clutch 13. Thus, these external and internal gears form coupling means 16 which couples the input end and the input gear 12 in axially slidable but rotatively drivable relationship. This arrangement significantly facilitates the assembling of the starter 1.

In the starter 1 having the above described structure, when the solenoid of the magnetic switch 5 is energized, the armature 6 is retracted as indicated by the arrow A. As a result, the shift lever 7 rotates in clockwise direction as seen in the drawing, and the sleeve member 10 is pushed inward against the biasing force of the return spring 11 so that the pinion gear 3 is pushed in the direction indicated by the arrow B along with the push rod 9 whose external radial flange 9*a* is pushed against the internal radial flange 10*a* of the sleeve member 10. At the same time, the switching action of the magnetic switch 5 causes electric current to be supplied to the motor 2, and a drive torque of the motor 2 is transmitted to the pinion gear support shaft 8 via the input gear 12 and the one-way clutch 13, thereby causing the pinion gear support shaft 8 to rotate along with the pinion gear 3. Therefore, the pinion gear 3 is pushed into meshing with the ring gear 4, and the ring gear 4 is then rotatively driven by the torque transmitted from the motor 2.

When the teeth of the ring gear 4 and the teeth of the pinion gear 3 are in mutual alignment, these two gears are not able to mesh with each other because the teeth of these gears will be struck against each other, and the displacement of the push rod 9 is stopped at an intermediate point of its stroke. Therefore, for the armature 6 of the magnetic switch 5 to be able to complete its stroke, a large load exceeding a prescribed level will be produced between the armature 10 6 and the push rod 9. However, according to the present invention, this excessive load is accommodated by the deformation of the shift spring 15. A certain resistance is encountered when pushing the pinion gear 3 into engagement with the ring gear 4, but since the pinion gear 3 is pushed via the shift spring 15, the gears are brought into mutual engagement with a certain elastic cushioning effect, and the possibility of damaging the teeth of these gears can be minimized.

According to the present invention, the shift spring 15 is capable of achieving such a result and is provided between the pinion gear 3 and the shift lever 7 or between the push rod 9 and the shift lever 7. Therefore, the shape of the shift lever 7 can be simplified without the shift lever 7 being required to be formed into a complicated shape for the purpose of mounting a torsion coil spring in a conventional manner. Further, since a compression coil spring can be used for the shift spring, and, in that case, it is possible to place the compression coil spring inside the sleeve member 10 having a cylindrical shape very easily. When the shift spring 15 is received in the sleeve member 10 as mentioned above, the action of the shift spring 15 can be stabilized because the shift spring 15 is favorably guided by the inner circumferential surface of the sleeve member 10.

Thus, according to the present invention, since the shift spring is provided between the push rod or the pinion gear and the shift lever, and is therefore not required to be mounted on the shift lever, the shape of the shift lever can be simplified, and the efforts required for assembling the starter can be reduced. In particular, because the shift spring consists of a compression coil spring which is coaxial with the push rod, the pinion gear, and the pinion gear support member, the starter may be constructed in a highly compact manner, and the action of the shift spring may be stabilized.

Although the present invention has been described in terms of a preferred embodiment thereof, it is obvious to a person skilled in the art that various alterations and modifications are possible without departing from the scope of the present invention which is set forth in the appended claims.

What we claim is:

1. A starter for an internal combustion engine, comprising:

a casing (1*a*);

a motor (2) attached to said casing (1*a*);

a tubular pinion gear support shaft (8) rotatably supported by said casing, and coupled to a drive shaft of said motor so as to be rotatively driven by said motor;

an annular pinion gear (3) fitted on said pinion gear support shaft in axially slidable but rotatively drivable relationship, said pinion gear being slidable between a retracted position and an extended position adapted for engagement with a ring gear of said internal combustion engine;

a return spring (11) for urging said pinion gear toward said retracted position;

a push rod (9) axially slidably received in said tubular pinion gear support shaft and provided with a free end engaged with a free end of said pinion gear for transmitting a shifting force for driving said pinion gear from said retracted position to said extended position;

a shift lever (7) pivotablly supported by said casing for transmitting said shifting force from a magnetic switch to said push rod; and a shift spring (15) consisting of a compression coil spring coaxially received in said pinion gear support shaft and interposed between an associated end of said shift lever and a base end of said push rod.

2. A starter according to claim 1, wherein said base end of said push rod is provided with an external radial flange (9*a*), and said shift spring is coaxially received in a sleeve member (10) having an internal radial flange (10*a*) engaged with said external radial flange of said push rod, said return spring consisting of a compression coil spring which is received coaxially between said push rod and said pinion gear support shaft, and is interposed between an external end surface of said internal radial flange (10*a*) and an opposing annular shoulder surface (8*a*) defined in said pinion gear support shaft.

3. A starter according to claim 2, wherein a disk member (14) is received in said sleeve member (10) and interposed between said associated end of said shift lever (7) and a first end of said shift spring (15), said sleeve member being provided with means (10*b*) for retaining said shift spring inside said sleeve member against the biasing force of said shift spring, and a second end of said shift spring is engaged with said external radial flange (9*a*).

4. A starter according to claim 3, further comprising an annular input gear (12) coaxially supported around said pinion gear support shaft with a one-way clutch (13) interposed therebetween, and a drive gear (2*b*) mounted on said drive shaft (2*a*) of said motor (2) meshes with said input gear (12).

5. A starter according to claim 4, wherein said input gear (12) is freely rotatably supported on said pinion gear support shaft (8), and said one-way clutch (13) has an output end (13*b*) securely fitted on said pinion gear support shaft (8) and an input end (13*a*) engaged with said input gear (12) via coupling means (16) which in axial and slidable assembly coupled said input end and said input gear in rotatively drivable relationship.

* * * * *